United States Patent [19]

Teasel et al.

[11] Patent Number: 4,488,385

[45] Date of Patent: Dec. 18, 1984

[54] BUILDING CONSTRUCTION

[75] Inventors: William A. Teasel, Bloomfield Hills; Thomas M. Teasel, Troy; Thomas R. Colwell, Lake Orion, all of Mich.

[73] Assignee: NFS Industries, Inc., Lake Orion, Mich.

[21] Appl. No.: 383,347

[22] Filed: May 28, 1982

[51] Int. Cl.[3] ..... E04B 7/02

[52] U.S. Cl. ..... 52/92; 52/293; 52/381; 52/414; 52/444; 52/251

[58] Field of Search ..... 52/90, 92, 91, 93, 293, 52/294, 344, 381, 414, 444, 250, 251

[56] References Cited

U.S. PATENT DOCUMENTS

| | | | |
|---|---|---|---|
| 1,105,682 | 8/1914 | Newert | 52/381 |
| 1,342,062 | 6/1920 | Perrot | 52/381 |
| 1,815,492 | 7/1931 | Bradley | 52/293 |
| 2,109,009 | 2/1938 | Hadley | 52/381 |
| 2,204,583 | 6/1940 | Falls | 52/381 |
| 2,690,072 | 9/1954 | Reed | 52/295 |
| 3,559,355 | 2/1971 | Day | 52/251 |
| 4,122,639 | 10/1978 | Barrell | 52/90 |

FOREIGN PATENT DOCUMENTS

| | | | |
|---|---|---|---|
| 1082669 | 12/1954 | France | 52/381 |

*Primary Examiner*—Henry E. Raduazo

*Attorney, Agent, or Firm*—Harness, Dickey & Pierce

[57] ABSTRACT

An improved building structure and construction method is disclosed wherein the wall structure includes internal wall forms with cementitious material applied thereon. A reinforcing structure for the cementitious material is provided whereby the foundation wall structure and roof structure are operatively interconnected in a load bearing relationship so that the strength and durability is significantly enhanced. The apparatus for attaching the internal wall forms to the roof structure includes means for conveniently aligning the wall forms in a straight and plumb relationship before the cementitious material is applied.

3 Claims, 11 Drawing Figures

FIG. 6.
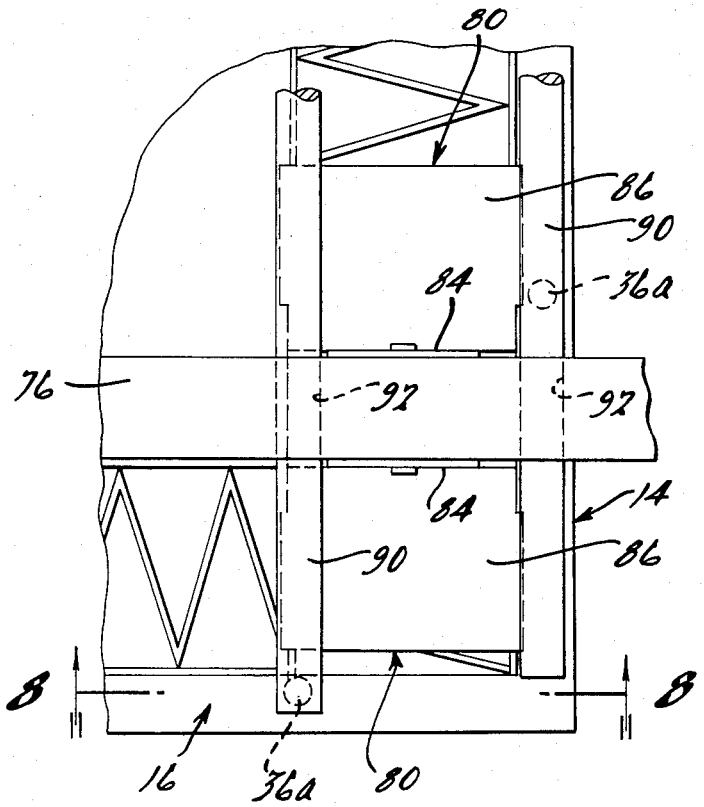
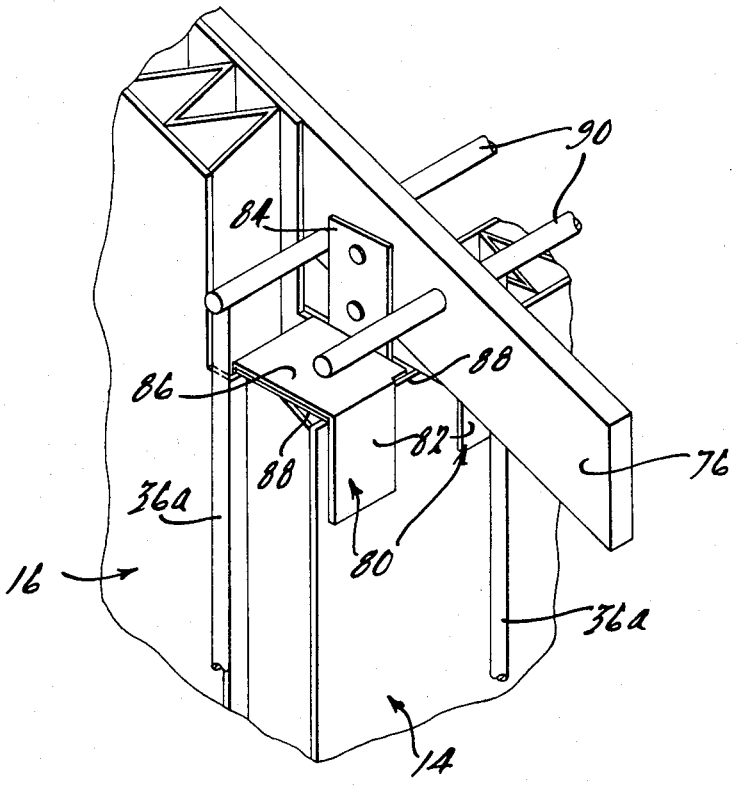
FIG. 7.

BUILDING CONSTRUCTION

BACKGROUND AND SUMMARY OF THE INVENTION

The invention relates generally to the construction of buildings. More particularly, the exemplary embodiment of the invention disclosed herein relates to residential construction.

The soaring costs of labor and of the materials used in traditional building construction has brought about the demand for sturdy, low-cost structures that may be easily and quickly constructed. This demand is especially acute in developing countries and has thus resulted in the development of various non-conventional construction techniques, and materials, such as pre-fabricated modules, components, and sub-structures. For the most part, however, such developments have not yet achieved an optimum combination of durability, strength and low cost.

According to the structure and methods of the present invention, an improved building construction includes a reinforced concrete wall structure formed by the application of a concrete or cementitious material to an internal wall form composed of an inexpensive sheet material such as corrugated cardboard. The wall forms are located inboard of the foundation to provide a load bearing surface for both inner and outer layers of the concrete material. The outer layer of concrete material extends beyond the upper edge of the foundation at least to the final grade elevation in order to seal the wall from water or insect infiltration. The concrete material is reinforced by previously-erected wire mesh and vertical reinforcing rods anchored at their lower ends in a concrete foundation.

At the upper edge of the wall structure, a series of pre-fabricated roof trusses are interconnected by horizontal tie rods, which form stringers and are integrally cast within the concrete material of the wall. At least at the trusses at the end of the building, the vertical reinforcing rods or studs adjacent the corners of the building structure are operatively connected with the tie rods to reinforce and unify the overall structure. The unique reinforcing structure, in combination with the concrete material, transmits the building load to the foundation, thereby permitting the use of such inexpensive and light-weight wall form materials. A number of truss attachment members interconnect the roof trusses and the wall forms during erection and include means for quickly and conveniently aligning the wall forms both vertically and laterally, thereby ensuring a finished wall that is both straight and plumb.

BRIEF DESCRIPTION OF THE DRAWINGS

FIG. 6 is a sectional view taken along line 6—6 of FIG. 2, prior to installation of the reinforcing mesh.

FIG. 7 is a perspective view illustrating the end truss attachment, prior to installation of the reinforcing material.

DETAILED DESCRIPTION OF THE PREFERRED EMBODIMENTS

FIGS. 1 through 10 depict, for the purposes of illustration only, an exemplary residential structure 10 according to the present invention. One skilled in the art will readily recognize, however, that the principles of the invention are equally applicable to other types and configurations of building structures. The preferred construction details and configuration of the structure 10 are set forth below, followed by a description of the method of constructing the structure.

Figure 1:
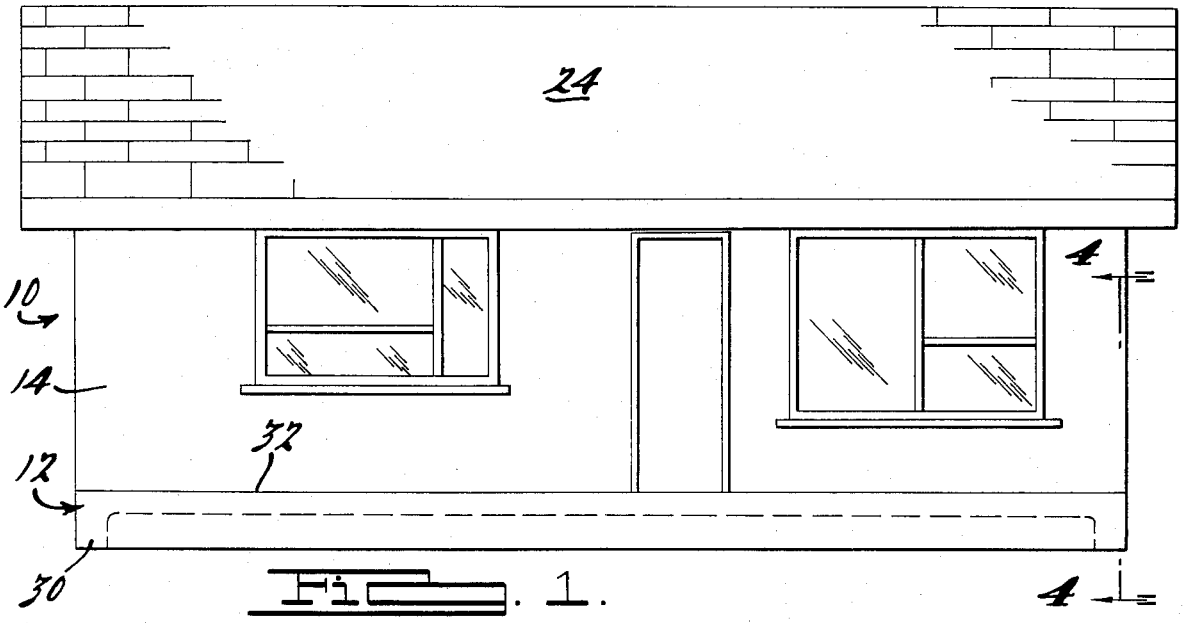
FIG. 1 is a front elevation view of an exemplary residential structure constructed in accordance with the present invention.
Figure 3:
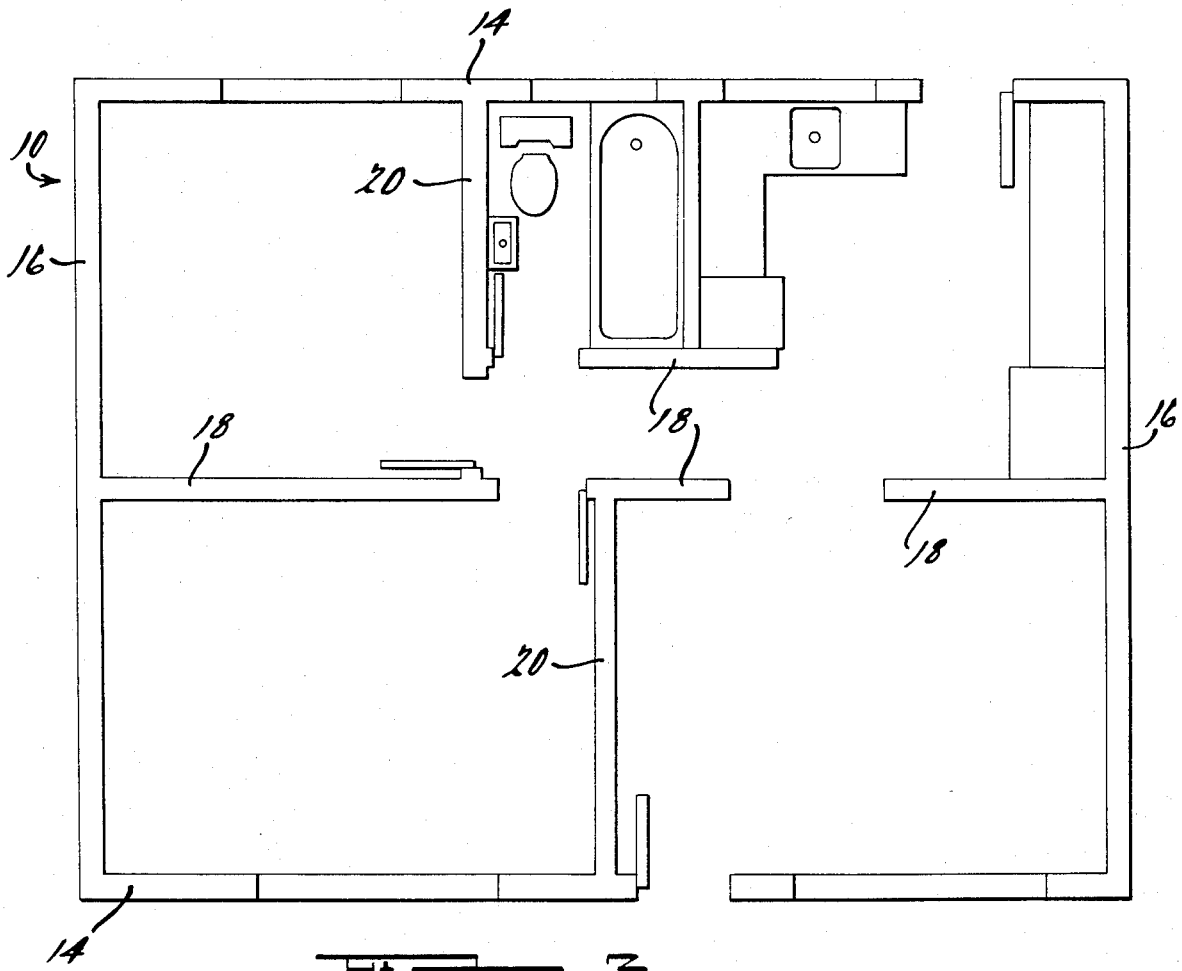
FIG. 3 is an exemplary view of the residential structure of FIGS. 1 and 2.
Figure 2:
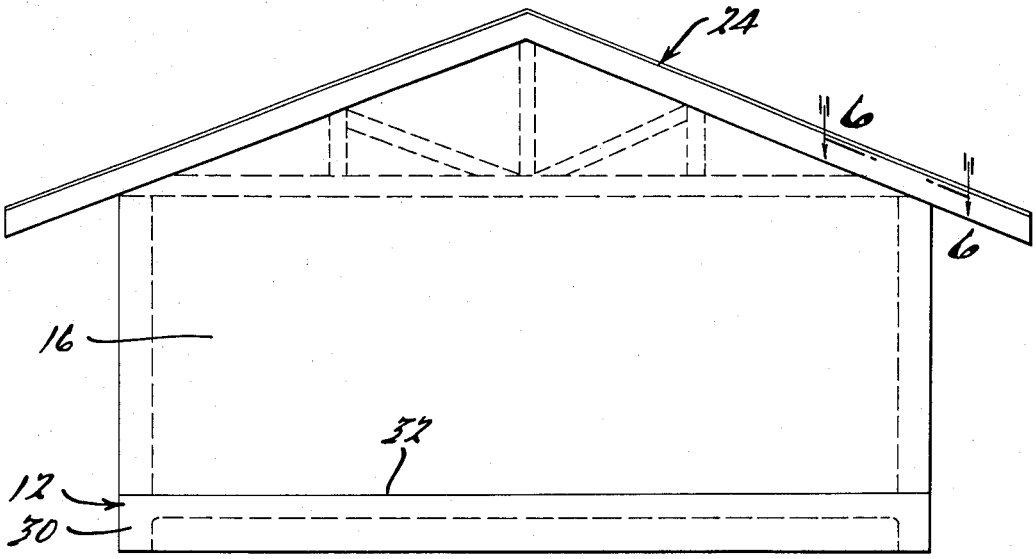
FIG. 2 is an end elevation view of the residential structure of FIG. 1.
Figure 4:
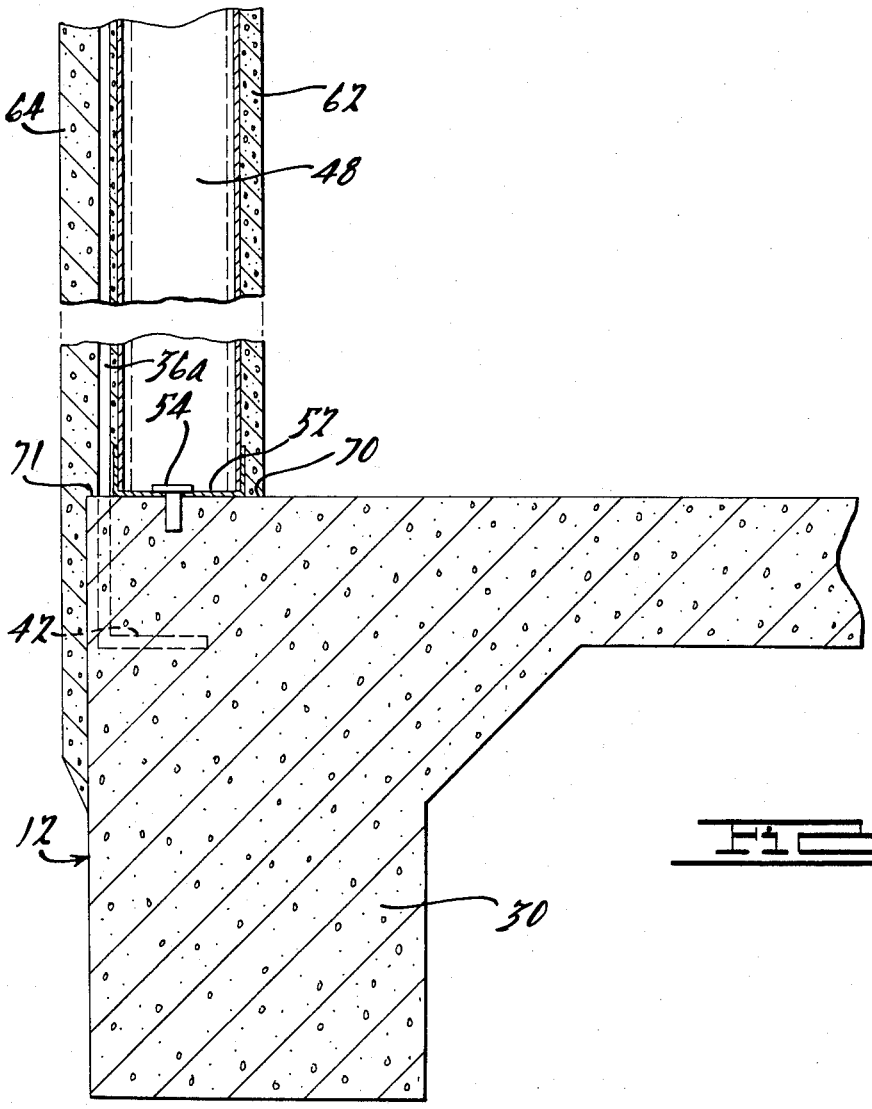
FIG. 4 is a sectional view taken along line 4—4 of FIG. 1.
Figure 5:
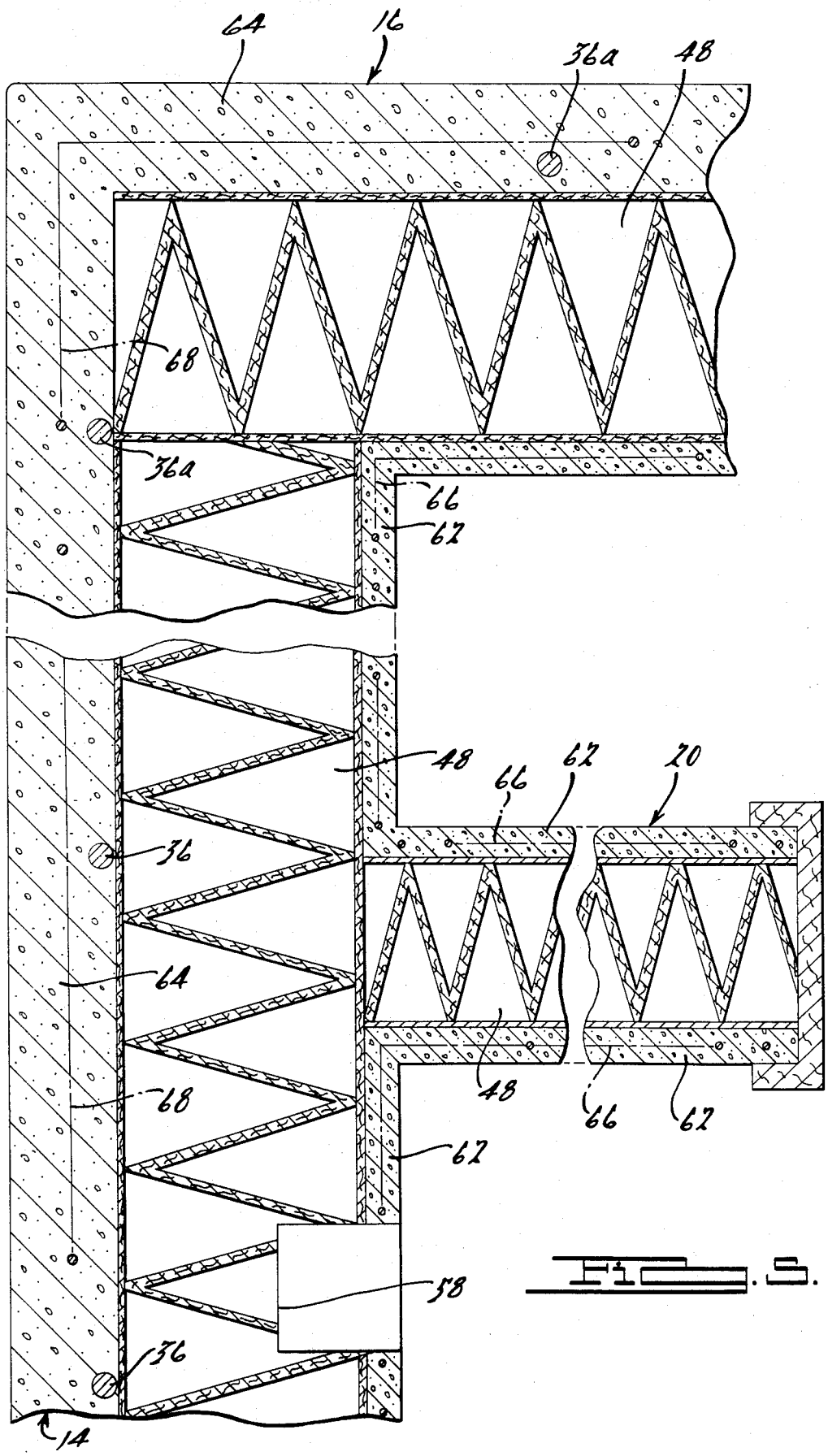
FIG. 5 is an enlarged view of a portion of FIG. 3, illustrating the construction details of the interior and exterior walls.

The structure 10 generally includes a foundation 12, front and rear exterior walls 14 and side exterior walls 16, interior partition walls 18 and 20, and a roof structure 24. In the particular building structure 10 shown here by way of illustration, the front and rear exterior walls 14 and the interior walls 18 extend in a direction perpendicular to the roof trusses (discussed below) of the roof structure 24, while the side exterior walls 16, and the partition walls 20, are parallel to such trusses. The foundation 12 includes footings 30 and a floor 32, which are both preferably composed of poured concrete. As shown in FIGS. 4 and 5, the interior and exterior walls of the stucture 10 include internal wall forms 48. The bottom edge portion of wall forms 48 are received within elongated wall channels 52, which are secured to the foundation 12 by channel anchor means 54 as shown particularly in FIG. 4. The channel anchor means 54 may comprise shot rivets, lag screws threadably engaging anchors embedded in the foundation 12, or other suitable anchor means known to those skilled in the art.

The wall forms 48 preferably comprise heavy-gauge corrugated cardboard sheets or panels. The corrugated cardboard wall forms are coated or treated with a water-proofing agent to prevent water damage during erection and also to avoid drawing water out of the freshly-applied concrete material (discussed below), thereby allowing the concrete material to properly cure. Although an overall wall form thickness of approximately 100 millimeters, for example, is considered suitable for most applications, wall forms having other thicknesses may be employed, depending upon the type and size of the structure, the material used and the conditions presented to the builder. The wall forms 48 serve as an internal form for inner and outer layers 62 and 64 of the concrete material. The wall forms 48 are constructed from sheets or panels that are as large as is practicable so that each wall may be virtually continuous, thereby saving time and labor by minimizing the number of joints and alignment operations required between adjacent panels.

A number of vertical intermediate reinforcing rods 36 are anchored in the footings 30 and protrude upwardly at spaced intervals about the periphery of the foundation 12 at the outer sides of the exterior walls to provide support therefor. Preferably, the intermediate reinforcing rods 36 on the exterior walls 14 are generally aligned with the roof trusses, with the intermediate reinforcing rods 36 on the exterior walls 16 being similarly spaced. A pair of corner reinforcing rods 36*a* are also similarly located at each corner of the building structure 10 to provide support for both the exterior walls and the roof structure 24.

In a preferred form of the invention, the reinforcing rods 36 and 36*a* include a hooked or bent portion at their lower ends which as illustrated for example in FIG. 4, may be generally L-shaped in configuration and include a horizontal leg 42. The hooked or bent portions not only resist vertical forces exerted on the reinforcing rods and lateral loads on the walls, but also provide added strength and reinforcement for the poured concrete foundation 12. The upper ends of the reinforcing rods 36 may be tied together with wire or rope for purposes of temporary alignment while the other components of the structure 10 are being erected.

As shown in FIGS. 6 through 10, the roof assembly 24 includes a number of pre-fabricated roof trusses 76 to which the wall forms 48 of the exterior walls 14 and the interior walls 18 are secured by means of truss brackets 80. Each of the brackets 80, which may be stamped from sheet metal or other sheet material, includes a pair of downwardly-protruding flanges 82 and an upwardly-protruding flange 84, with the flanges being interconnected by a generally horizontal base portion 86. A space 74 is provided in the bracket 80 between the edge of the flanges 82 and the plane of the flange 84 to allow clearance for the thickness of the cardboard inner layer of the wall form 48 when the bracket 80 is installed at an intersection of two wall forms such as that shown in FIG. 5. The downwardly-protruding flanges 82 of each bracket 80 normally, however, interlockingly engage or straddle opposite sides of the wall form 48, and the upwardly-protruding flange 84 engages a side of the roof truss 76. The base portion 86 engages a generally flat bearing plate 88 on the upper edge of the wall form 48. The brackets 80 are secured to the roof truss 76 by nails, screws or other suitable fastening means. A pair of load-bearing tie rods 90 project horizontally through pre-drilled openings 92 near each end of the trusses 76 and extend the length of the walls 14 or 18 to interconnect the trusses.

Figure 8:
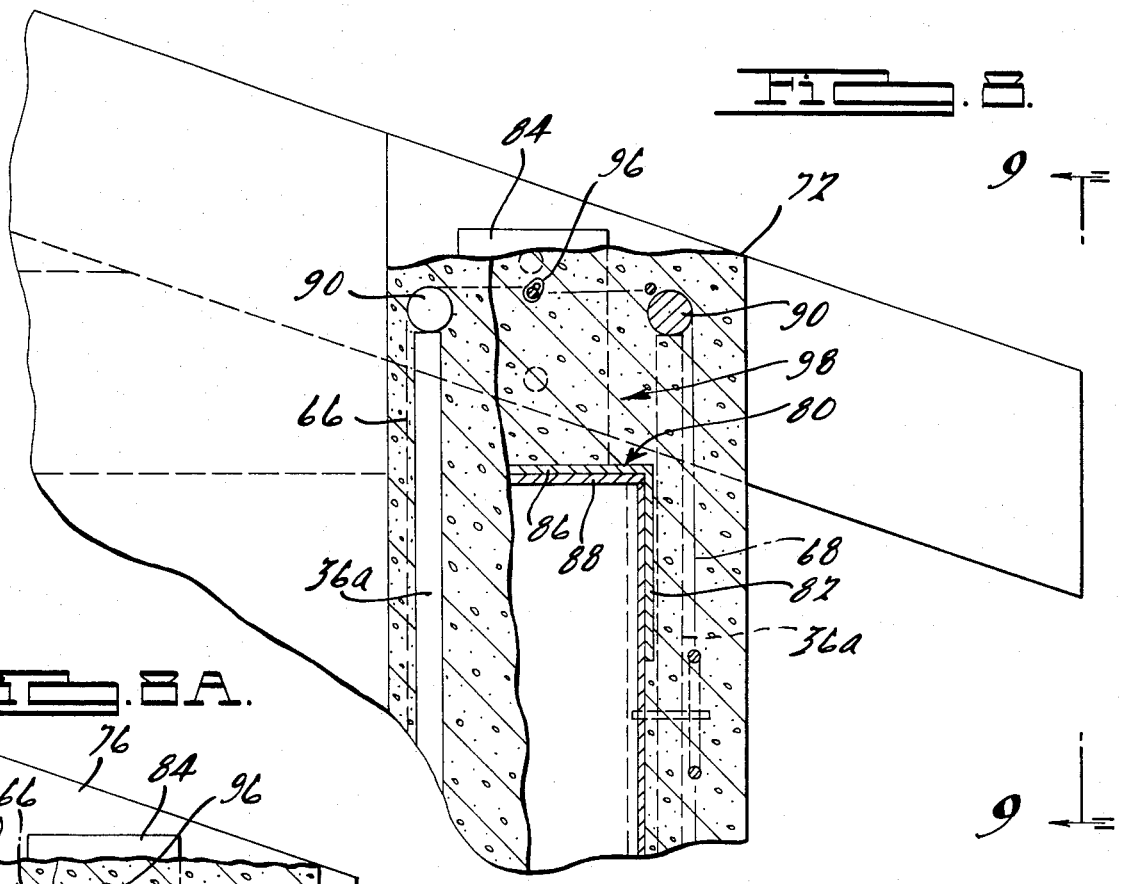
FIG. 8 is a sectional view taken along line 8—8 of FIG. 6.
Figure 8A:
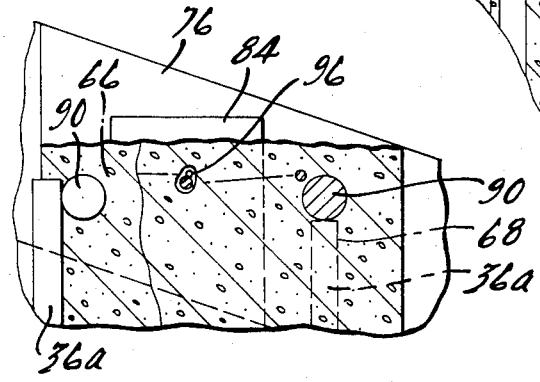
FIG. 8A is a sectional view similar to that of FIG. 8, illustrating an alternate construction.
Figure 10:
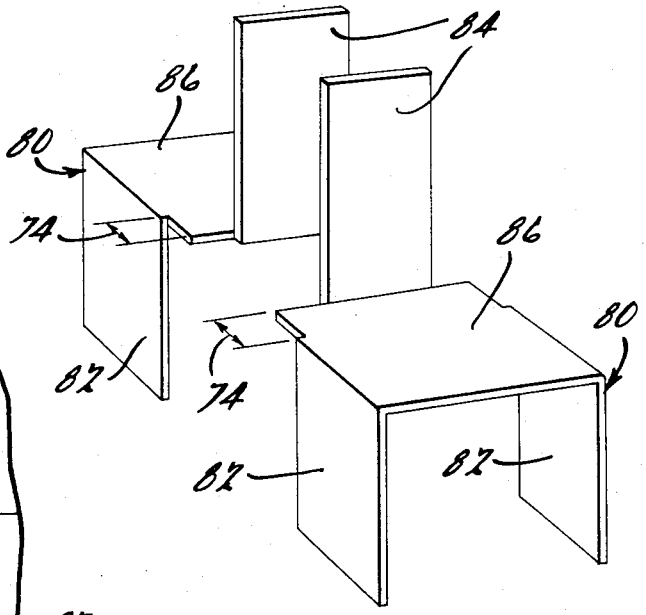
FIG. 10 is a perspective view of the truss attachment brackets, shown in FIGS. 6 through 9.

At the corners of the building structure 10, the pair of vertical reinforcing rods 36*a* extend upwardly from the foundation 12 to the horizontal tie rods 90 and preferably either abut, or are secured to, the latter as shown alternatively in FIGS. 8 and 8A, respectively. The horizontal tie rods 90 also serve as a securing or anchoring structure for the inner and outer reinforcement mesh 66 and 68, which are folded over the tie rods and joined together by wire 96 or other suitable securing means. Thus, once the concrete material of the inner and outer layers 62 and 64 has hardened into a solid mass 98 between the trusses at the upper edge of the wall to effectively form a reinforced concrete beam, the load of the entire series of roof trusses is transferred to the foundation of the structure through the concrete layers and the load-carrying interaction of the horizontal tie rods 90 and the vertical corner reinforcing rods 36*a*. The structure is further strengthened and unified by the interaction of the reinforcing mesh 66 and 68, the horizontal tie rods 90, the short vertical reinforcing rods 36 and the hardened concrete material. The inner and outer concrete layers 62 and 64 are also supported directly by underlying bearing surfaces 70 and 71 at the top of the foundation 12, as shown in FIG. 4.

Typically, the concrete or cementitious material is made up of approximately four parts sand and one part cement, by weight, and may be applid pneumatically to the wall forms 48 and to the inner and outer reinforcement mesh 66 and 68, respectively, as described below. Preferably the thickness of the outer layer 64 is approximately two to four times that of the inner layer 62. Thus, for example, the outer layer 64 may be approximately 45 millimeters thick, while the inner layer 62 may be approximately 15 millimeters thick. Because of the additional thickness of the outer layer 64, the outer reinforcement mesh 68 is preferably comprised of a heavy gauge wire mesh, while the inner reinforcement mesh 66 may be of a lighter gauge similar to that of so-called "chicken wire". The inner and outer reinforcement mesh 66 and 68 are folded around the edges and ends of the wall forms 48 and tied together with wire at their junctions. As will be described below, before the application of the inner and outer concrete layers 62 and 64, the reinforcement mesh is loosely attached to the wall forms 48 by staples, or other suitable fastening means, and is also secured to the reinforcing rods 36 and 36*a*.

The method of constructing this structure 10 may be described by the following steps or operations. After the foundation 12 has been poured into suitable forms, but before the concrete has hardened, the reinforcing rods 36 and 36*a* are pushed into the concrete at the respective desired locations. If necessary, the reinforcing rods may be supported at their free ends by wire or rope to maintain their orientation while the concrete foundation sets.

After the foundation 12 has hardened, wall channels 52 are secured thereto at the desired locations by anchor means 54. Next the interior and exterior wall forms 48 are inserted into the channels 52 and secured to each other at their intersections by means of staples, wire, or any suitable fasteners or adhesives.

Once all the interior and exterior wall forms 48 have been installed, the roof trusses 76 are erected on the bearing plates 88, the wall forms are aligned in a straight and plumb position, and the end wall forms 48 for the exterior walls 14 are secured to the end trusses by means of the truss brackets 80. If needed, one or more pieces of roof board may be tacked to the trusses to hold them together while they are being secured to the brackets 80. The tie rods 90 are then inserted through the openings 92 in the trusses.

Once the trusses 76 and the wall forms 48 are in place, the window and door openings may be cut and the basic electrical wiring may be installed by pushing the cable or conduit either vertically or horizontally through the wall forms and into electrical boxes, such as box 58 in FIG. 5, for example. The reinforcing mesh is wired or otherwise fastened to the reinforcing rods 36 and 36*a* and stapled to the interior and exterior of the wall forms 48. The reinforcing mesh may also be folded over the edges of the window and door openings prior to installation of the window and door frames. The inner and outer reinforcement mesh 66 and 68 is then folded over the tie rods 90 and joined by wire 96 as shown in FIGS. 6 and 6A.

The concrete material is next applied to the wall forms 48 to form the inner and outer wall layers 62 and 64. The material is applied by a pneumatic process wherein the sand and cement are conveyed or "sprayed" through a nozzle under air pressure and mixed with water in the proper proportions as it is "sprayed" onto the wall forms. The concrete material typically comprises approximately four parts sand and one part cement. The concrete material is known commercially by the generic name of "shotcrete", and is sometimes referred to as "jetcrete", in reference to the "JETCRETER" brand apparatus for applying the concrete material. "JETCRETER" is a registered trademark of NFS Industries, Inc. of Troy, Mich., U.S.A. Another known example is "GUNITE" brand application apparatus. "GUNITE" is a registered trademark of Allentown Pneumatic Gun Co. of Allentown, Pa., U.S.A.

Figure 9:
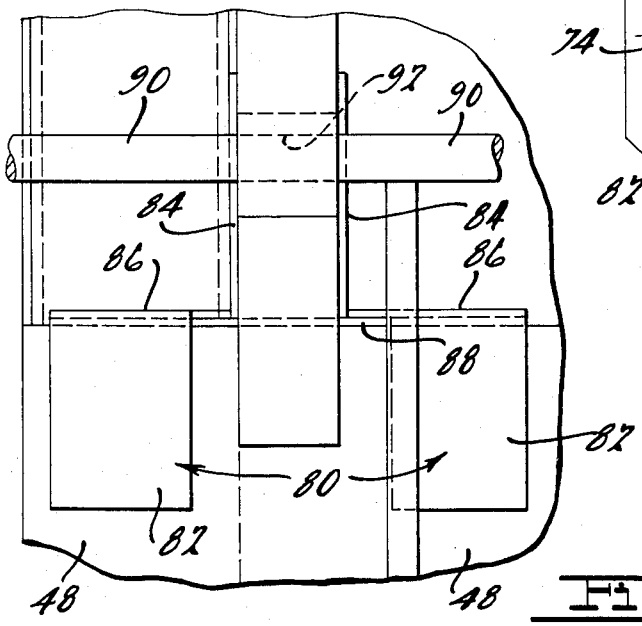
FIG. 9 is an elevational view taken along line 9—9 of FIG. 8.

During the application of the concrete material, it is especially important to substantially fill the spaces between the trusses to a level above the tie rods and the reinforcing mesh, thereby forming the solid mass or concrete "beam" 98 so that the truss and roof loads will be transferred to the foundation 12 as described above and also so that the wall is sealed to the roofline as indicated by reference numeral 72 in FIG. 9. The spaces between the door and window frames and the wall forms should also be filled to provide a neat appearance and a solid, tight seal therebetween. Furthermore, the concrete material for outer layer 64 should be applied to the exterior of the structure to a level below the upper edge or surface of the foundation 12, as shown in FIG. 4, so that the walls of the structure may be sealed to the foundation to prevent infiltration of moisture or insects. Preferably, such concrete material should be applied at least down to the natural grade level of the building site. After the concrete material has been applied, it may be troweled or otherwise formed to either a smooth or textured finish as desired.

Finally, after the concrete material has set, conventional roofing materials may be installed to finish the roof assembly 24, and the doors, windows, ceiling materials, finish wiring, finish plumbing, fixtures, and other components may be added to complete the structure 10.

The foregoing discussion discloses and describes merely exemplary embodiments of the present invention. One skilled in the art will readily recognize from such discussion that various changes, modifications and variations may be made therein without departing from the spirit and scope of the invention as defined in the following claims.

What is claimed is:

1. In a building structure of the type having a poured concrete foundation, a roof structure including a roof truss at each end of said building structure and a plurality of spaced roof trusses therebetween, and a wall structure having load bearing walls supported by said foundation and supporting said roof structure, the improvement wherein said load bearing walls comprise internal wall forms coated with inner and outer layers of cementitious material;

wherein said foundation includes a bearing surface adjacent said wall forms for supporting said cementitious material; and wherein said load bearing walls are provided with a plurality of truss brackets each having a pair of spaced, downwardly-extending flanges and upwardly-extending flanges interconnected by a base plate, said downwardly-extending flanges engaging opposite sides of said wall forms and said upwardly-extending flanges being adapted to be secured to said roof trusses, and bearing plates disposed between the base plates of said truss brackets and the upper edges of said wall forms, and first and second vertical support means comprising attachment means for attaching said wall forms to said roof trusses and for aligning said wall forms in a predetermined relationship relative to said foundation, and a reinforcing structure for said cementitious material, said reinforcing structure and said wall forms being encased within said cementitious material, said attachment means including horizontal load-carrying means interconnecting said roof trusses, said first vertical support means comprising rod means having hooked portions anchored in said foundation and extending upwardly through the outer layers of said load bearing walls to a position closely adjacent said horizontal load-carrying means and the endmost of said roof trusses, and said second vertical support means being anchored in said foundation at spaced locations along said load bearing walls, and inner and outer reinforcement mesh material being disposed in respective inner and outer layers of said cementitious material and secured to said horizontal load-carrying means and to said first and second vertical support means.

2. A building structure according to claim 1, wherein the outer layer of cementitious material of said load bearing walls extends downwardly below the top of said foundation.

3. In a building stucture of the type having a poured concrete foundation, and a roof structure including end and intermediate roof trusses, the improvement comprising a wall structure having load bearing walls interposed between said foundation and said roof structure, at least certain of said load bearing walls having first support means comprising core means of cardboard sheet material and surface coatings of cementitious material on and bonded to said cardboard core means, said cardboard means being supported at the lower edges thereof by said foundation and supporting said roof structure at the upper edges thereof and collectively being sufficiently strong at least initially to support the full weight of said roof trusses independently of said cementitious coatings, whereby to permit said walls and said roof trusses to be erected on said foundation before said cementitious surface coatings are applied to the cardboard surfaces of said core means, said certain load bearing walls further including second support means comprising upright, reinforcing rods embedded in said cementitious coatings and supported by said foundation, and rigid support means supported by said upright reinforcing rods interconnecting and supporting said roof trusses, said rigid support means comprising tie rods extending through and disposed in load bearing relation with said roof trusses, and portions of said tie rods overlying and being supported by said upright reinforcing rods, whereby the roof truss load is transferred to said foundation in part through said cardboard core means and in part through said tie rods and said upright reinforcing rods.

* * * * *

UNITED STATES PATENT AND TRADEMARK OFFICE

CERTIFICATE OF CORRECTION

PATENT NO. : 4,488,385

DATED : December 18, 1984

INVENTOR(S) : William A. Teasel, Thomas M. Teasel, Thomas R. Colwell

It is certified that error appears in the above-identified patent and that said Letters Patent is hereby corrected as shown below:

Column 6, (Claim 3) line 43, after "cardboard" insert -- core --.

Signed and Sealed this

*Twenty-first* Day of *May 1985*

[SEAL]

*Attest:*

DONALD J. QUIGG

*Attesting Officer* *Acting Commissioner of Patents and Trademarks*